United States Patent [19]

Flick et al.

[11] Patent Number: 4,554,427

[45] Date of Patent: Nov. 19, 1985

[54] MOLDED CASE CIRCUIT BREAKER WITH MOVABLE LOWER ELECTRICAL CONTACT

[75] Inventors: Robert H. Flick, Brighton Township, Beaver County; Walter K. Huffman, Towamencin Township, Montgomery County, both of Pa.

[73] Assignee: Westinghouse Electric Corp., Pittsburgh, Pa.

[21] Appl. No.: 562,602

[22] Filed: Dec. 19, 1983

[51] Int. Cl.[4] ..... H01H 1/24

[52] U.S. Cl. ..... 200/250; 200/245

[58] Field of Search ..... 200/153 G, 244, 249, 200/250, 251, 245, 246, 247

[56] References Cited

U.S. PATENT DOCUMENTS

| | | | |
|---|---|---|---|
| 1,512,235 | 10/1924 | Perry | 200/249 |
| 1,807,815 | 6/1931 | White | 200/250 |
| 2,238,383 | 4/1941 | Collins | 200/249 |
| 2,615,109 | 10/1952 | Favre | 200/244 |
| 3,158,720 | 11/1964 | Wiktor | 200/251 |
| 3,293,397 | 12/1966 | Zubaty et al. | 200/153 G |
| 4,245,203 | 7/1981 | Wafer et al. | 200/244 |

FOREIGN PATENT DOCUMENTS

| | | | |
|---|---|---|---|
| 473980 | 3/1929 | Fed. Rep. of Germany | 200/250 |
| 1092100 | 11/1960 | Fed. Rep. of Germany | 200/250 |

*Primary Examiner*—John W. Shepperd
*Attorney, Agent, or Firm*—M. S. Yatsko

[57] ABSTRACT

A molded case circuit breaker includes a movable lower electrical contact having a formed stationary member, a movable contact arm, a pair of electrical contact compression springs, a contact arm compression spring and a contact secured to the upper end of the movable contact arm for physically and electrically contacting a separable upper electrical contact. An integral longitudinal end portion of the stationary member extends through the base of the cirucit breaker to form an external terminal of the circuit breaker. The opposite longitudinal end of the stationary member is curved for receiving a rotatable pin fixedly secured to the movable contact arm for rotation therewith. The rotatable pin is biased by the pair of compression springs into effective current conducting contact with the curved end of the stationary member. The contact arm compression spring contacts the underside of the movable contact arm to bias the contact secured thereto into engagement with the upper electrical contact. Upon the occurrence of a high level short circuit or fault current condition, the movable contact arm rotates against the force of the contact arm compression spring to achieve rapid separation of the upper and lower electrical contacts.

14 Claims, 2 Drawing Figures

MOLDED CASE CIRCUIT BREAKER WITH MOVABLE LOWER ELECTRICAL CONTACT

CROSS REFERENCE TO RELATED APPLICATIONS

The invention disclosed herein relates to molded case circuit breakers. The inventions disclosed in the following four commonly assigned United States patent applications also relate to molded case circuit breakers: U.S. patent application Ser. Nos. 440,680; 440,681; 440,682; and 440,683, all of which were filed on Nov. 10, 1982.

The following five commonly assigned United States patent applications were filed in the U.S. Patent and Trademark Office on Dec. 19, 1983, the same day as this patent application and also relate to molded case circuit breakers: Ser. No. 562,647 filed by Alfred E. Maier and entitled Molded Case Circuit Breaker With An Apertured Molded Cross Bar For Supporting A Movable Electrical Contract Arm; Ser. No. 562,648 filed by Robert H. Flick and Walter K. Huffman and entitled Molded Case Circuit Breaker With Movable Upper Electrical Contact Positioned By Tension Springs; Ser. No. 562,643 filed by Robert H. Flick and Walter K. Huffman and entitled Molded Case Circuit Breaker With Improved Operating Mechanism; Ser. No. 562,644 filed by Alfred E. Maier and entitled Molded Case Circuit Breaker With Adjustable Stationary Lower Electrical Contact; and Ser. No. 562,603 filed by Robert H. Flick and Walter K. Huffman and entitled Molded Case Circuit Breaker With Movable Upper Electrical Contact Positioned By Torsion Springs.

BACKGROUND OF THE INVENTION

A. Field of the Invention

The device of the present invention generally relates to molded case circuit breakers and, more particularly, to electrical contacts used in such circuit breakers.

B. Description of the Prior Art

Circuit breakers and, more particularly, molded case circuit breakers are old and well known in the prior art. Examples of such devices are disclosed in U.S. Pat. Nos. 3,525,959; 3,614,865; 3,815,059; 3,863,042; 4,077,025; and 4,166,205. In general, prior art molded case circuit breakers have been provided with movable contact arrangements and operating mechanisms designed to provide protection for an electrical circuit or system against electrical faults, specifically, electrical overload conditions, low level short circuit or fault current conditions, and, in some cases, high level short circuit or fault current conditions. Prior art devices have utilized a trip mechanism for controlling the movement of an over-center toggle mechanism to separate a pair of electrical contacts upon an overload condition or upon a short circuit or fault current condition. Such trip mechanisms have included a bimetal movable in response to an overload condition to rotate a trip bar, resulting in the movement of the over-center toggle mechanism to open a pair of electrical circuit breaker contacts. Such prior art devices have also utilized an armature movable in response to the flow of short circuit or fault current to similarly rotate the trip bar to cause the pair of contacts to separate. At least some prior art devices use blow-apart contacts to rapidly interrupt the flow of high level short circuit or fault currents. In such devices, the lower electrical contact of the blow apart contacts may be stationary; or it may be movable. Movable lower electrical contacts have often utilized flexible current carrying copper shunts to transfer current from an external terminal of the circuit breaker to the lower electrical contact.

While many prior art devices have provided adequate protection against fault conditions in an electrical circuit, a need exists for dimensionally small molded case circuit breakers capable of fast, effective and reliable operation and, more specifically, for a compact, lower electrical contact that is capable of movement away from an associated upper electrical contact during high level short circuit or fault current conditions and that can be electrically connected in the circuit breaker without the use of a flexible conductive shunt attached thereto.

SUMMARY OF THE INVENTION

An object of the present invention is to provide a new and improved circuit breaker.

Another object of the present invention is to provide a new and improved molded case circuit breaker having a compact, lower electrical contact capable of movement away from an upper electrical contact during high level short circuit or fault current conditions.

Another object of the present invention is to provide a new and improved molded case circuit breaker having a movable lower electrical contact electrically connected in the circuit breaker without the use of a flexible current carrying shunt attached to the lower electrical contact.

Briefly, the present invention relates to a molded case circuit breaker having a movable lower electrical contact that occupies a relatively small amount of space while providing fast, effective and reliable operation in protecting an electrical circuit or system from electrical fault conditions. The lower electrical contact includes a formed stationary member secured to the base of the circuit breaker by a mounting screw, a movable contact arm, a pair of electrical contact compression springs, a contact arm biasing means or compression spring and a contact for physically and electrically contacting a separable upper electrical contact.

An integral longitudinal end portion of the stationary member extends through the base of the circuit breaker to form an external terminal of the circuit breaker. The opposite longitudinal end of the stationary member is configured as a pair of integrally formed, spaced apart, generally curved contacting portions, each of which includes two, spaced apart, flat surfaces inclined at an angle of approximately 45 degrees to the plane of the base or lower flat portion of the stationary member. The stationary member also includes an integrally formed stop for limiting the movement of the movable contact arm.

The movable contact arm is fixedly secured to a rotatable pin for rotation therewith within the curved contacting portions of the stationary member. The rotatable pin is biased by a pair of compression springs into effective current conducting contact with the flat surfaces of the curved contacting portions of the stationary member. The contact for physically and electrically contacting the separable upper electrical contact is secured to the upper end of the movable contact arm. Thus, a current carrying conductive path is formed between the external terminal and the contact mounted at the upper end of the movable contact arm through the stationary member and its curved contacting portions, the rotatable pin and the movable contact arm.

A compression spring contacts the underside of the movable contact arm to bias the contact secured thereto into engagement with the upper electrical contact. However, upon the occurrence of a high level short circuit or fault current condition, the resultant high magnetic repulsion forces generated by the flow of fault current through generally parallel portions of the upper and lower electrical contacts cause the rapid downward movement of the movable contact arm against the bias of the compression spring. An extremely rapid separation of the upper and lower electrical contacts and a resultant large increase in the resistance across the electrical arc formed therebetween is achieved to provide effective fault current limitation.

BRIEF DESCRIPTION OF THE DRAWING

The above and other objects and advantages and novel features of the present invention will become apparent from the following detailed description of the preferred and alternative embodiments of a molded case circuit breaker illustrated in the accompanying drawing wherein.

DESCRIPTION OF THE PREFERRED EMBODIMENT

Figure 1:
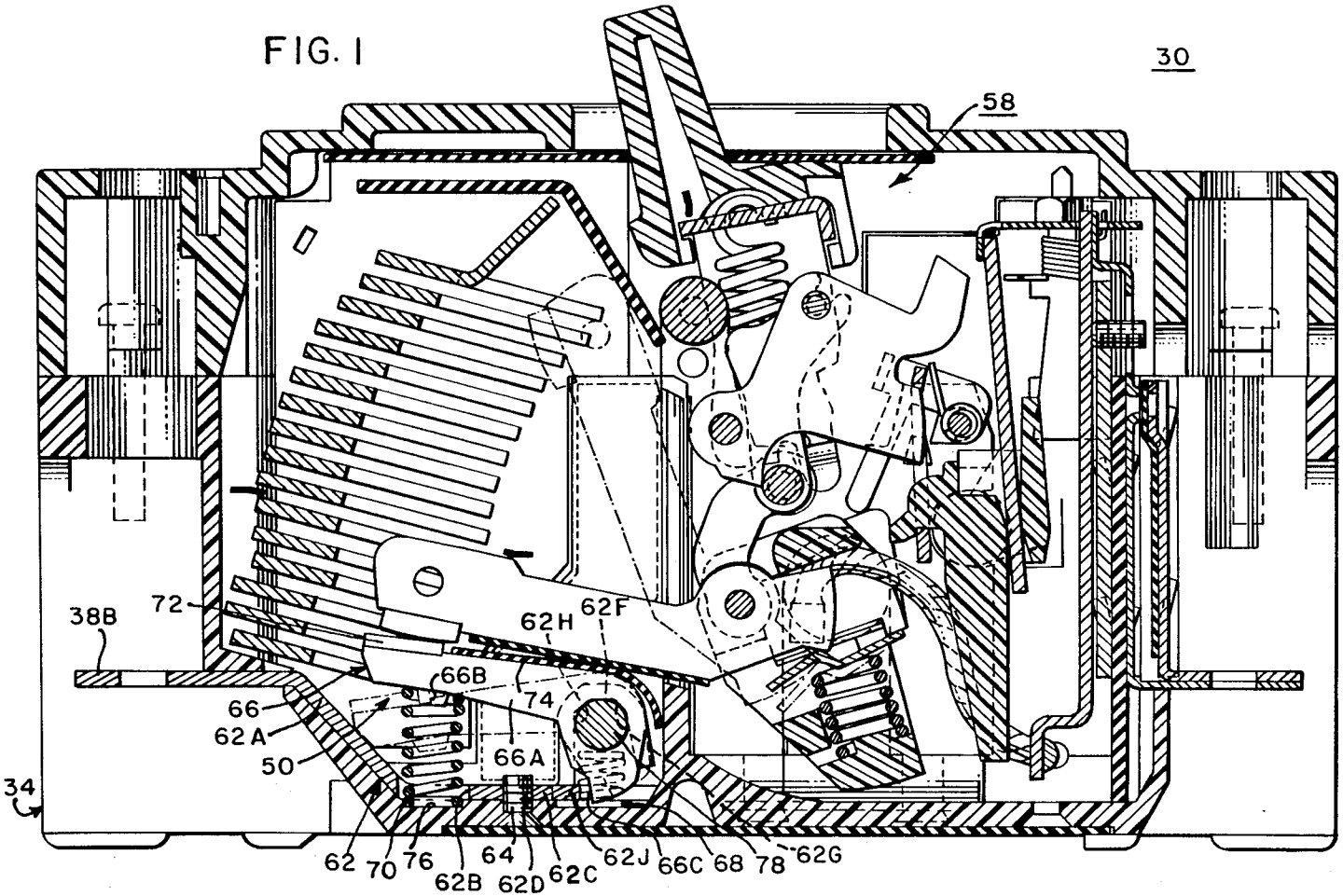
FIG. 1 is an enlarged, cross sectional view of a molded case circuit breaker depicting the device in its CLOSED and BLOWN-OPEN positions.

The present invention relates to electrical contacts used in molded case circuit breakers 30 of the type where an operating mechanism 58 operates in response to a trip unit 82 to move a movable contact 52 from a CLOSED position to an OPEN position. A detailed description of such a molded case circuit breaker 30 in which the contacts of the present application can preferably be used in U.S. Application Ser. No. 562,643, filed Dec. 19, 1983, which material is hereinto incorporated by reference.

Figure 2:
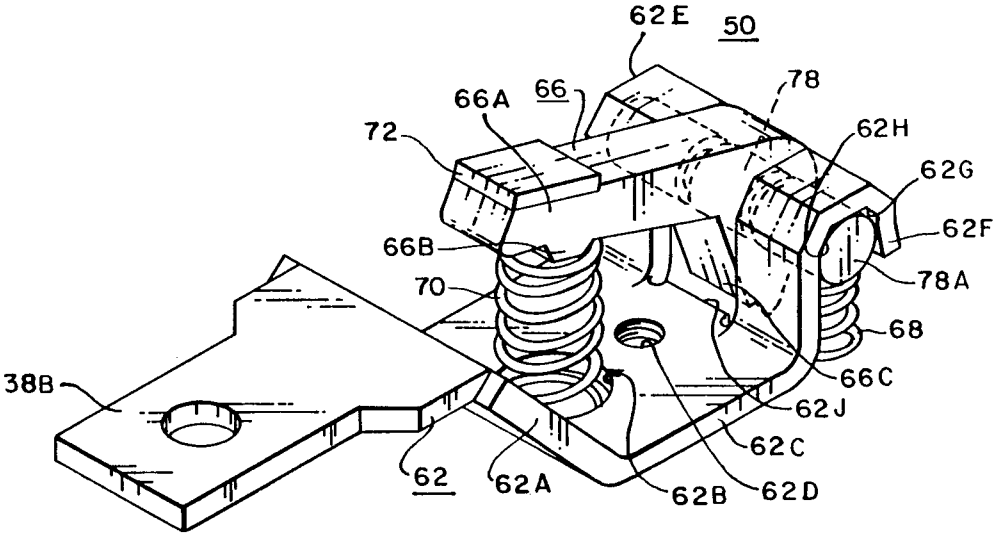
FIG. 2 is an enlarged, perspective view of the lower movable contact structure shown in FIG. 1.

The lower electrical contact 50 (FIGS. 1 and 2) includes a lower, formed, stationary member 62 secured to the base 34 by a fastener 64, a lower movable contact arm 66, a pair of electrical contact compression springs 68, a lower contact biasing means or compression spring 70, a contact 72 for physically and electrically contacting the upper electrical contact 52 and an electrically insulating strip 74 to reduce the possibility of arcing between the upper electrical contact 52 and portions of the lower electrical contact 50. The line terminal 38B extending exteriorly of the base 34 comprises an integral end portion of the member 62. The member 62 includes an inclined portion 62A that serves as a lower limit or stop for the moving contact arm 66 during its blow-open operation; an aperture 62B overlying a recess 76 formed in the base 34 for seating the compression spring 70; and a lower flat section 62C through which the aperture 62B is formed. The flat section 62C may also include a threaded aperture 62D formed therethrough for receiving the fastener 64 to secure the stationary member 62 and thus the lower electrical contact 50 to the base 34. The stationary member 62 includes a pair of spaced apart, integrally formed, upstanding, generally curved or U-shaped contacting portions 62E and 62F. The contacting portions 62E and 62F each include two, spaced apart, flat, inclined surfaces 62G and 62H, inclined at an angle of approximately 45 degrees to the plane of the lower flat section 62C and extending laterally across the inner surfaces of the contacting portions 62E and 62F. A stop 62J (FIG. 2) is provided for limiting the upward movement of the contact arm 66.

The contact arm 66 is fixedly secured to a rotatable pin 78 for rotation therewith within the curved contacting portions 62E and 62F about the longitudinal axis of the rotatable pin 78. The rotatable pin 78 includes outwardly extending round contacting portions 78A that are biased by the compression springs 68 into effective current conducting contact with the surfaces 62G and 62H of the portions 62F and 62E, respectively. In this manner, effective conductive contact and current transfer is achieved between the lower formed stationary member 62 and the lower movable contact arm 66 through the rotatable pin 78. The lower movable contact arm 66 includes an elongated rigid lever arm 66A extending between the rotatable pin 78 and the contact 72 and a downwardly protuberant portion or spring locator 66B for receipt within the upper end of the compression spring 70 for maintaining effective contact between the lower movable arm 66 and the compression spring 70. Finally, the lower movable contact arm 66 includes an integrally formed, flat surface 66C formed at its lower end for contacting the stop 62J to limit the upward movement of the lower movable contact arm 66 and the contact 72 fixedly secured thereto.

The lower electrical contact 50 as described hereinabove utilizes the high magnetic repulsion forces generated by high level short circuit or fault current flowing through the elongated parallel portions of the electrical contacts 50 and 52 to cause the rapid downward movement of the contact arm 66 against the bias of the compression spring 70. An extremely rapid separation of the electrical contacts 50 and 52 and a resultant rapid increase in the resistance across the electrical arc formed between the electrical contacts 50 and 52 is thereby achieved, providing effective fault current limitation within the confines of relatively small physical dimensions. The lower electrical contact 50 further eliminates the necessity for utilizing flexible copper shunts used in many prior art molded case circuit breakers for providing a current carrying conductive path between a terminal of the circuit breaker and a lower movable contact arm of a lower electrical contact. The use of the compression springs 68 to provide a constant bias against the pin 78 provides an effective current path between the terminal 38B and the contact 72 while enabling the mounting of the lower electrical contact 50 in a small, compact area.

Obviously, many modifications and variations of the present invention are possible in light of the above teachings. Thus it is to be understood that, within the scope of the appended claims, the invention may be practiced otherwise than as specifically described hereinabove.

What is claimed and desired to be secured by Letters Patent is:

1. An electrical circuit breaker comprising a first electrical contact and a second movable electrical contact, said first and second electrical contacts being movable into a CLOSED position and into an OPEN position, said second electrical contact comprising a stationary member having a first longitudinal end forming an external electrical terminal of said circuit breaker and a second longitudinal end configured as a pair of upstanding spaced-apart curved contacting portions having an opening therebetween, said second electrical contact further comprising an elongated movable contact arm having contact means for engaging said first electrical contact fixedly secured at one longitudinal end thereof and pin means fixedly secured to said movable contact arm and remotely disposed from said contact means for rotatably engaging said curved contacting portions, said pin means comprising a cylindrical portion extending outwardly from each side of said contact arm in a direction perpendicular to the direction of elongation of said contact arm and being disposed within said stationary member curved contacting portions, said contact arm being disposed within, and rotatable within, the opening between said spaced-apart curved contacting portions, said second electrical contact further comprising a compression spring physically engaging each of said pin means cylindrical portions and maintaining said pin means in engagement with said curved contacting portions to enable effective current transfer between said stationary member and said movable contact arm, said second electrical contact further comprising biasing means physically engaging said movable contact arm for yieldably biasing said movable contact arm towards said CLOSED position.

2. An electrical circuit breaker as recited in claim 1 wherein said yieldably biasing means comprises an elongated contact pressure compression spring.

3. An electrical circuit breaker as recited in claim 2 further comprising a molded case formed from electrically insulating material within which said first and second electrical contacts are disposed, said molded case including an interior surface.

4. An electrical circuit breaker as recited in claim 3 wherein said molded case includes a recess formed in said interior surface, a first longitudinal end of said elongated contact pressure compression spring being disposed in said recess.

5. An electrical circuit breaker as recited in claim 4 wherein said movable contact arm includes a protuberant portion for retaining a second longitudinal end of said elongated contact pressure compression spring in contact with said movable contact arm.

6. An electrical circuit breaker as recited in claim 1 wherein said movable contact arm includes limit means for engaging a portion of said formed stationary member to limit the movement of said movable contact arm.

7. An electrical circuit breaker as recited in claim 1 further comprising a substantially flat integrally formed portion of said stationary member disposed between said first and second longitudinal ends, each of said pair of curved contacting portions having at least two, spaced apart, flat surfaces inclined at an angle of approximately 45 degrees to the plane of said substantially flat portion of said stationary member.

8. An electrical circuit breaker comprising a first electrical contact and a second electrical contact, said first and second electrical contacts being movable into a CLOSED position and into an OPEN position, said first electrical contact comprising a stationary member having a first longitudinal end forming an external electrical terminal of said circuit breaker and a second longitudinal end configured to provide a current transfer surface and an integrally formed contact arm stop surface, said first electrical contact further comprising a movable contact arm having contact means fixedly secured at one longitudinal end thereof for engaging said second electrical contact, rotatable means fixedly secured to said movable contact arm for rotatably engaging said current transfer surface of said stationary member and a stop portion capable of contacting said formed contact arm stop surface, said first electrical contact further comprising means for maintaining said rotatably engaging means in engagement with said current transfer surface to enable effective current transfer between said stationary member and said movable contact arm, said first electrical contact further comprising means for yieldably biasing said contact arm towards said closed position, said contact arm stop surface engaging said stop portion to limit movement of said contact arm as it moves towards said CLOSED position.

9. An electrical circuit breaker as recited in claim 8 wherein said maintaining means comprises at least one spring physically engaging said rotatable means.

10. An electrical circuit breaker as recited in claim 9 wherein said spring comprises a compression spring.

11. An electrical circuit breaker as recited in claim 8 wherein said second longitudinal end comprises a generally U-shaped contacting portion.

12. An electrical circuit breaker as recited in claim 11 wherein, said generally U-shaped contacting portion includes at least two, spaced apart, flat surfaces inclined at an acute angle to the plane of said planar portion.

13. An electrical circuit breaker as recited in claim 8 wherein said yieldably biasing means comprises a compression spring.

14. An electrical circuit breaker as recited in claim 13 further comprising a molded case formed from electrically insulating material in which said first and second electrical contacts are disposed, said molded case including an interior surface having a recess formed therein, a first longitudinal end of said compression spring being disposed in said recess and a second longitudinal end of said compression spring being disposed in contact with said movable contact arm.

* * * * *